United States Patent [19]

Duffner et al.

[11] 4,026,628

[45] May 31, 1977

[54] ELECTRICAL CONNECTOR FOR CABLES AND MAGNETIC FORMING PROCESS FOR SAME

[75] Inventors: Morris V. Duffner, Garden City; Alexander Mintz, Smithtown, both of N.Y.

[73] Assignee: Grumman Aerospace Corporation, Bethpage, N.Y.

[22] Filed: Dec. 18, 1975

[21] Appl. No.: 642,080

Related U.S. Application Data

[62] Division of Ser. No. 569,690, April 21, 1975, Pat. No. 3,992,773.

[52] U.S. Cl. ..... 339/177 E
[51] Int. Cl.² ..... H01R 17/08
[58] Field of Search ..... 339/177, 177 R, 177 E

[56] References Cited

UNITED STATES PATENTS

| | | | |
|---|---|---|---|
| 2,761,110 | 8/1956 | Edlen et al. | 339/177 R |
| 2,798,113 | 7/1957 | Koller et al. | 339/177 E X |
| 2,878,458 | 3/1959 | Jackson | 339/177 R |
| 2,941,028 | 6/1960 | Edlen et al. | 339/177 R X |
| 3,054,848 | 9/1962 | Reesby et al. | 339/177 R |
| 3,539,976 | 11/1970 | Reynolds | 339/177 E |
| 3,613,050 | 10/1971 | Andrews | 339/177 R |
| 3,781,763 | 12/1973 | Feeser et al. | 339/177 E X |

*Primary Examiner*—Gerald A. Dost
*Attorney, Agent, or Firm*—Richard G. Geib; Mellor A. Gill

[57] ABSTRACT

An electrical connector having a deformable tubular shell between a cable and fitting manufactured by a process of magnetically deforming the shell at one end to the underlying cable and at the other end to the underlying fitting to provide a superior EMI and shielding integrity as well as a good water tight seal without the need of potting the connection or providing special seal elements.

4 Claims, 8 Drawing Figures

ELECTRICAL CONNECTOR FOR CABLES AND MAGNETIC FORMING PROCESS FOR SAME

This is a division of application Ser. No. 569,690, filed Apr. 21, 1975 now U.S. Pat. No. 3,992,773.

SUMMARY

The present invention relates generally to a cable fitting, and is more particularly concerned with a means and method of connecting a cable to a fitting.

Known prior art cable fittings within the field in which this invention is concerned either employ a potted assembly of a fitting and the various cable elements or utilizes a plurality of parts such as contact wedges, clamps and seals assembled to integrate a fitting and a cable.

Cable with which this invention is concerned are commonly referred to in the field as coaxial cables, i.e., a conductor supported by an insulate (dielectric) about which another conductor is provided that may or may not be of a braided form to provide an internal, external shield for the conductor depending upon the utilization thereof.

As may be readily appreciated by those skilled in the art it is necessary to provide a fitting for such cables and a connection therebetween that does not degrade the EMI and shielding integrity that is desired for the cable throughout the cable and assembly length. Furthermore, since the cable and fitting are exposed to the elements the assembly is to provide an environmental seal in the area of the connection of the cable and fitting.

It is therefore a principal object of this invention to insure a superior EMI and shield integrity of a cable-fitting connection that is further enhanced by the forming of a superior seal at the same time.

It is another object of this invention to enable the reduction of weight in such cable-fitting connection as well as a reduction in physical size of such an assembly to permit a wider adaptability of the products formed by the use of this invention.

DRAWING DESCRIPTION

Other objects and advantages of this invention will become apparent to those skilled in the art from a reading of the following description in reference to the drawings in which.

DETAIL DESCRIPTION

Figure 1:
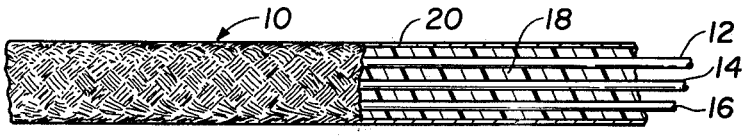
FIG. 1 is a partial section of a cable such as may be employed in this invention with a portion thereof broken away in cross-section.
Figure 2:
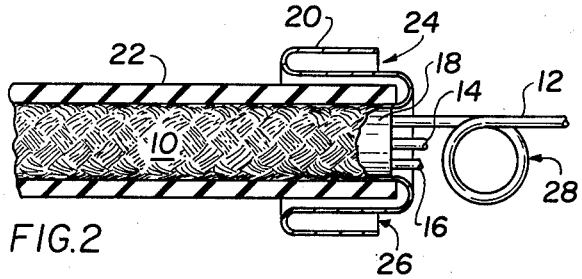
FIG. 2 is a partial cross-section of an end of a coaxial cable that has been processed for the mating with a fitting in accordance with the principals of this invention.
Figure 3:
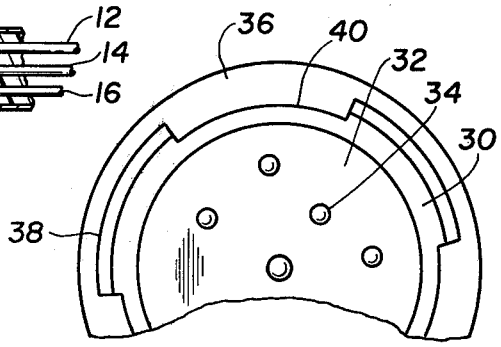
FIG. 3 is a partial end view of a fitting adapted to be mated with the cable of FIG. 2.
Figure 6:
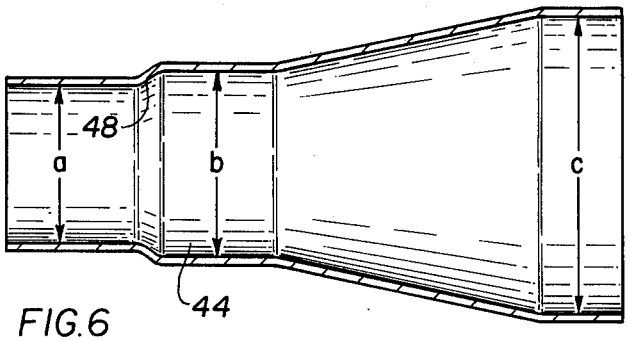
FIG. 6 is a cross-sectional view of a shell to provide the connection between the cable and fitting in accordance with this invention.
Figure 5:
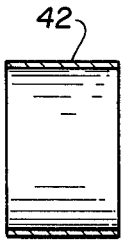
FIG. 5 is a cross-sectional view of ring to be used in a connection in accordance with this invention.
Figure 4:
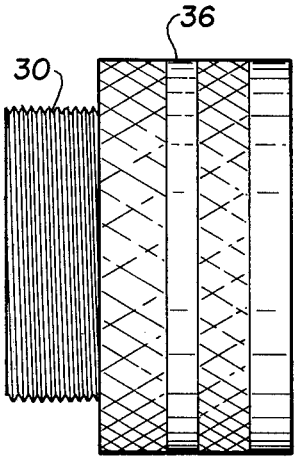
FIG. 4 is a side view of the fitting.

With reference now to FIG. (1) there is shown an electrical cable 10 having a plurality of inner conductors 12, 14, and 16 supported by an insulator (dielectric) 18 within an outer conductor 20 that may be a continuous structure or of a braided form, as shown.

As seen in FIG. (2) the cable 10 is provided with an outer insulator cover 22. The cover 22 may be a rubber tube or from an insulator (dielectric) material similar to that within the cable 10. In any event the cover 22 extends to an end of the cable, as shown, where the outer conductor 20 and inner conductors 12, 14 and 16 have been striped away from their insulator. As shown, the outer conductor 20 is striped away so as to form two loops 24 and 26 extending back over the cover 22. In addition, the inner conductors may be formed to have a loop 28 ahead of the cable 10.

The cable 10 of FIG. (2) is now ready for joining with a fitting, as depicted by FIGS. (3) and (4). More particularly, the fitting has a body 30 supporting a dielectric plug 32 that in turn supports receptacles or pins 34. About the body is rotatably secured a nut connection 36 that is shown in FIG. (3) to include a plurality of slots 38 and flanges 40 to provide a bayonet type connection with a similarly formed nut connection to another cable. In such event, as will be readily understood by those skilled in the art, one such fitting utilizes receptacles 34 and the other, mating, fitting utilizes pins 34.

With reference now to the elements needed to connect the cable 10 and the fitting body 30 there is shown a ring 42 by FIG. (5) and a shell 44 by FIG. (6). As seen by FIG. (7) the ring 42 is placed within the loops 24 and 26 and the shell 44 placed there over such that the shell 44, loops 24 and 26, and ring 42 will provide a sandwich about the cover 22 on the cable 10 at the cable end of the shell 44. At the other end of the shell the fitting body 30 is placed within the shell opening. The fitting body 30 is formed in the area of mating with the shell 44 with serrations such as the threaded type shown by FIG. (4) or the knurled type as shown by FIG. (7). Shell 44 is designed so as to of a step diameter having a dimension *a* for slight interference contact with cover 22, a deminsion *b* for slight interference fit with the sandwich of the loop 24, 26 and ring 42 thereunder and a dimension *c* for slight interference fit with the fitting body 30, in a preferred form so as to orient the various pieces one with the other for subsequent integration. In such a preferred form the ring 42 will also be dimensioned to provide a slight interference fit with the surface of the shield 20 within the loops 24 and 26 for holding the loops against the cover 22. As may be readily understood by those skilled in the art of forming to be hereinafter discussed in greater deaial this is not a critical requirement in that the shell 44 and ring 42 could be oversized for a sloppy fit and other means employed to orient them with respect to the areas of the cable 10 and fitting body 30 to which they are to be joined in connection of the cable 10 and fitting body 30.

Figure 8:
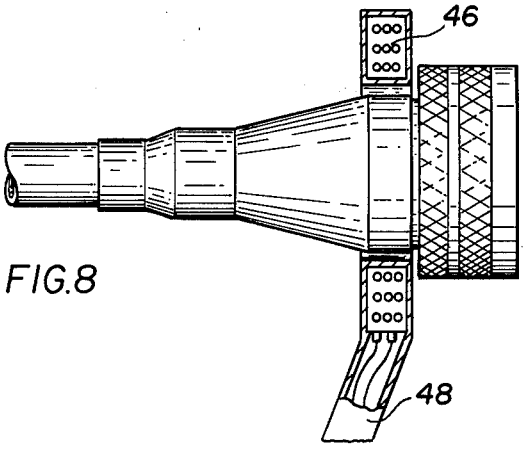
FIG. 8 is a side view of a cable fitting connection with a cross-sectional view of a magnetic forming tool to be utilized in the process in accordance with this invention.

The forming process employed involves the application of high intensity magnetic field within the coils 46 of a tool 48, see FIG. 8, so as to induce eddy currents in the shell 44. The eddy currents interact with the magnetic field and result in force that can be utilized to form the shell 44 in the area of the tool 48 to the underlining sandwich of the loops 24, 26 and ring 42 or the underlining fitting body 30. With such a forming process, as will be readily apparent to those skilled in the art, the amount of energy which can be transferred to the shell 44 depends on the voltage applied to the coil 46, the duration and shape of the current pulse in the coil and the magnetic coupling between the tool 48 and shell 44. In other words, the basic theory of magnetic pulse forming is that a high impulse of current is applied to a coil or wire, thus producing a magnetic field of high intensity between the coil 46 and the shell 44. During the high current impulse, eddy currents that develop on the shell 44 restrict the magnetic field to the surface of the shell 44. The interaction of magnetic and eddy currents creates inward force on the shell 44 thus causing shell 44 to conform to the surface that it is being mated to.

It should be noted at this junction that an additional function of the cover 22 is to absorb some of the inward force of the shell 44 to prevent indentation of the cable dielectric 18 and thereby prevent disturbance of the cable impedance characteristics.

Of considerable importance also is the resistance of the materials forming both the ring 42 and shell 44 since resistance determines the eddy current flow that will take place. Numerous materials having low resistivity such as, for example, aluminum have been successfully used to form the connection between the cable 10 and fitting body 30 with excellent results. It should be noted also, that the magnetic properties of the material from which the ring 42 and shell 44 which are deformed by the magnetic forming process is relatively unimportant because of the extreme intense magnetic fields that may be expected to be generated in the coil 46 of tool 48.

In summary, the cable-fitting connection of this invention is realized from a process whereby a cable, is obtained or made in the usual manner to have inner conductors supported by a dielectric shielded by an outer conductor either of a braided or tubular shell type. Thereafter a cover, for example, a rubber tube, is placed over the shielded cable up to a pre-determined distance from an end thereof. The end of the cable is opened, as by splitting the braided outer conductor and removing the support dielectric from the inner conductors. The shield that has been split beyond the cover 22 is returned back over the cover and formed to have a loop end. In the case of braided cable shield this is done by combing the braided cable into the loops 24 and 26; First, by combing shield 20 back along the cover 22, placing the aluminum ring 42 thereover and mechanically or magnetically crimping the ring at a desired location. Thereafter the braided cable shield 20 is combed over the ring to complete the loops 24 and 26. With a tubular shield conductor 20 the ends are split into strips and bent back and over as in the combing process for a braid.

Next the shell 44 is slid along the rubber cover 22 until shoulder 48 abuts the loops 24 and 26 with the ring interposed. The tool 48 is then brought up along the cover 22 and over shell 44 in the areas of the dimension *b* and a timed electrical discharge is passed through the coil 46. Obviously, the tremendous forces produced when coil 46 is properly energized by a time pulse would tend to rupture or destroy the coil by repelling it away from the shell 44. If it is desired to retain the coil disrupter forces while concentrating the flux pass of the magnetic field through the ring 44 to be magnetically formed, then the coil 46 may be encased in one or more metal jackets or other suitable rigid covering material of the tool 48. Therefore, as the magnetic flux field builds up in coil 46 and is applied to shell 44 the shell 44 will be repelled away from the coil, as above-described.

As may be readily appreciated by those skilled in the art one could use a sliced copper ring in the place of the encased coils to create the magnetic forming forces. Also one could use heavy copper wire formed as a coil about shell 44 without a casing in which event the coil would be destroyed during forming. The forming coil could also be designed to provide shaped forming forces. One means of doing this is to take a copper slug, say for example six inches in diameter, and drill from one end for a predetermined axial distance a five inch bore and from the other a two inch bore. This would permit localizing the forming forces in the greater coil mass. In any event these variants of forming tools would not detract from the purposes of the disclosure of this invention but are rather referenced to show the wide adaptability of the invention to known magnetic forming processes.

Figure 7:
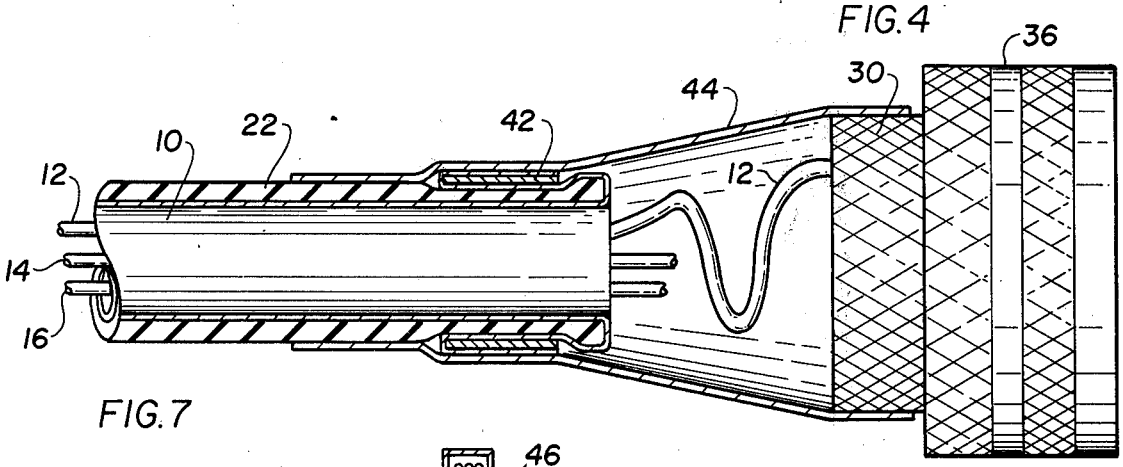
FIG. 7 is a cross-sectional view of the assembly of a cable and fitting with the ring and shell of FIGS. 5 and 6.

Thereafter, conductor 12, 14, 16, etc. are connected to the receptacles or pins 34 of the dielectric plug 32 of the fitting body 30. Then the fitting body 30 is inserted within the open area of shell 44 having the dimension *c* by a twisting motion which will twist the conductors 12, 14, and 16 one turn to form a strain relief for the conductors 12, 14, 16, etc. within the area of the shell 44 between cable 10 and fitting body 30, as seen by FIG. 7. The tool 48 is than brought up the shell 44 to the position shown in FIG. 8 and a timed electrical discharge is passed through the coil 46, as before, to deform the shell 44 on the fitting body and within the valleys of the depressions of the serrated surface thereof under shell 44.

It should also be noted that in the forming of shell 44 in its area represented by dimension *b* about the cable and of the assembly desired that the shell 44 could be deformed to flow between the strands of the combed braid or the strip of the tubular shield 20 to provide greater surface bond areas as with the flow of the connector end into the valleys of the serrations.

From the foregoing it should be obvious that the objects of the invention have been completed, namely the formation of a connector between a cable and fitting without the need for potting and the use of wedges, clamps, etc. by means of a deformable ring and shell of low resistivity material that will take the shape of the cable and the fitting to which it is being formed to thus have good mechanical and electrical integrity to the fitting and cable shield as well as a strain relieved connection of the cable inner-conductor to the fitting; and, in addition, by taking the shape of the cable and the fitting, the shell is deformed sufficiently to provide a water tight seal between the rubber cover for the cable and the serrated surfaces of the fitting.

The above disclosure of the invention is with reference to but a limited number of embodiments. Obviously, it is possible for a person skilled in the art to produce other variations without departing from the inventive concept disclosed herein. Therefore, it is desired that only such limitations be imposed upon the appended claims as stated therein or as are required by the prior art.

We claim:

1. An electrical connector for a coaxial cable of the type including a dielectric about at least one inner conductor between same and an outer conductor such as a braided sheath over said dielectric, said connector comprising:

a connection nut having provision for the inner conductor;

an insulating tube about the outer conductor, said outer conductor being a braided cable, said braided cable being split at one end to lay back over and adjacent the insulating tube about said outer conductor a predetermined distance from whence it is returned to comprise a loop adjacent the end of the insulating tube;

a metal ring located in the loop of said outer conductor over said insulating tube; and a tube means bridging the space between the insulating tube beyond the loop and the connection nut, said tube means being formed and affixed to surfaces of the outer conductor braided cable loop and surfaces of the connection nut that include separate raised areas on their surfaces under the tube means that will with the braided cable surfaces provide increased surface area than a smooth surface for the forming and affixing of the tube means to join outer conductor and connection nut such that the area therebetween is sealed from the environment.

2. A means to join a cable having a central conductor and an outer conducting sheath and insulation both between said conductor and sheath and about said sheath with a fitting permitting electrical continuity from the sheath to the fitting and from the central conductor to a dielectric supported means in said fitting, said means to join comprising:

a looped end for said sheath lying over the insulation about said sheath characterized by the sheath being a braided cable, said braided cable being split at one end to lay back over and adjacent the insulation about said sheath a predetermined distance from whence it is returned to comprise the looped end;

an annular ring within said looped end of said sheath; and a tubular casing mechanically bonded to said looped end of said sheath at one end of the tubular casing and to the fitting at the other end of the tubular casing such that the mechanical bond is within the area between the cable and the fitting as is the central conductor within the tubular casing whereby the mechanical integrity and electrical continuity is sealed from the environment by the casing and the area at each end that are respectively affixed to the cable and the fitting.

3. The structure of claim 2 wherein the casing is of aluminum.

4. A means to join a cable having a central conductor and an outer conducting sheath spaced by an insulate with a fitting, said means comprising:

an insulate cover over said sheath up to a predetermined location spaced back from the end of said sheath, said sheath being laid back onto and therefore over said cover;

an annular ring on said sheath onto and therefore over said cover, said sheath being returned onto and therefore over said ring such that said ring is sandwiched between a looped end of said sheath and located adjacent the end of said sheath where it begins to lay back onto and therefore over said cover;

a tubular casing mechanically bonding said sandwiched ring in the looped end and the sheath thereto at one end of the tubular casing to the fitting at the other end of the tubular casing with which the central conductor is communicable therethrough and the outer conductor is connectable thereby.

* * * * *